US009187722B2

(12) United States Patent
Zander et al.

(10) Patent No.: US 9,187,722 B2
(45) Date of Patent: Nov. 17, 2015

(54) CONTROLLING A RELEASE OF A CLEANING AGENT BY SORBING THE AGENT ON SILICA PARTICLES

(71) Applicant: The Dial Corporation, Scottsdale, AZ (US)

(72) Inventors: Tasha Zander, Phoenix, AZ (US); Travis T. Yarlagadda, Phoenix, AZ (US)

(73) Assignee: The Dial Corporation, Scottsdale, AZ (US)

( * ) Notice: Subject to any disclaimer, the term of this patent is extended or adjusted under 35 U.S.C. 154(b) by 51 days.

(21) Appl. No.: 13/896,124

(22) Filed: May 16, 2013

(65) Prior Publication Data

US 2014/0187464 A1 Jul. 3, 2014

Related U.S. Application Data

(63) Continuation-in-part of application No. 13/730,708, filed on Dec. 28, 2012, now Pat. No. 8,790,670.

(51) Int. Cl.

| | |
|---|---|
| ***C11D 3/08*** | (2006.01) |
| ***C11D 3/386*** | (2006.01) |
| ***C11D 7/14*** | (2006.01) |
| ***C11D 17/04*** | (2006.01) |
| ***C11D 3/12*** | (2006.01) |
| ***C11D 17/00*** | (2006.01) |

(52) U.S. Cl.

CPC ..... *C11D 17/043* (2013.01); *C11D 3/124* (2013.01); *C11D 17/003* (2013.01); *C11D 17/0034* (2013.01); *C11D 17/041* (2013.01)

(58) Field of Classification Search

CPC ..... C11D 17/043; C11D 17/041; C11D 3/08; C11D 3/124; C11D 3/1246; C11D 3/386; C11D 3/505; C11D 7/14; C11D 17/003; C11D 17/0034

See application file for complete search history.

(56) References Cited

U.S. PATENT DOCUMENTS

| | | | | |
|---|---|---|---|---|
| 2003/0082115 | A1* | 5/2003 | Allred | 424/53 |
| 2005/0192190 | A1* | 9/2005 | Hasenzahl et al. | 510/130 |
| 2011/0236493 | A1 | 9/2011 | Canham et al. | |
| 2011/0271458 | A1 | 11/2011 | Enselberg | |
| 2012/0244103 | A1* | 9/2012 | Davis et al. | 424/78.02 |
| 2012/0304397 | A1 | 12/2012 | MacDonald et al. | |
| 2013/0164236 | A1* | 6/2013 | Yarlagadda et al. | 424/65 |

FOREIGN PATENT DOCUMENTS

EP 0919611 A1 6/1999

OTHER PUBLICATIONS

PCT International Search Report (PCT/US2013/071566) dated Feb. 27, 2014.

* cited by examiner

*Primary Examiner* — Charles Boyer
(74) *Attorney, Agent, or Firm* — Thomas G. Krivulka

(57) ABSTRACT

Compositions and apparatus are provided for controlling a release of a cleaning agent with silica particles. Silica particles disposed within the gel composition and are configured to at least partially dissolve in an alkaline environment. Further, an active cleaning agent sorbed by the silica particles is configured to be released from the silica particles upon partial dissolution of the silica particles.

8 Claims, 1 Drawing Sheet

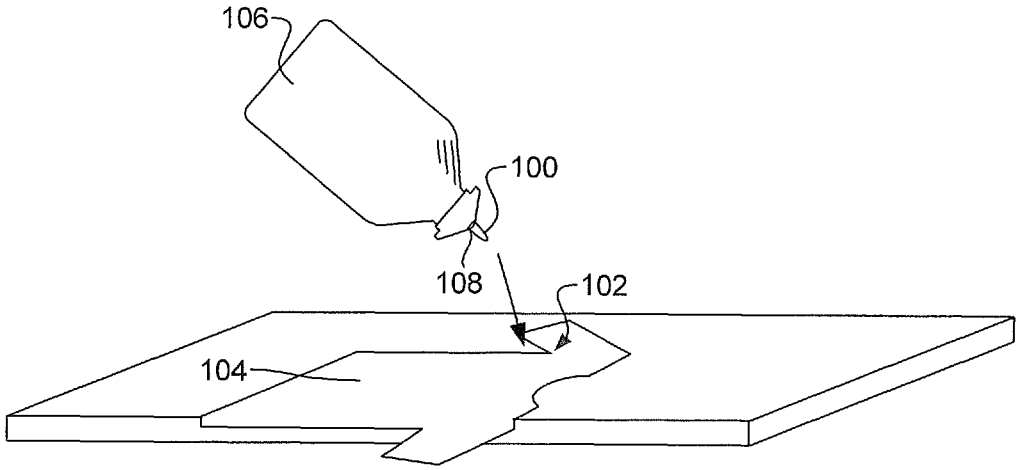
106
100
108
102
104

CONTROLLING A RELEASE OF A CLEANING AGENT BY SORBING THE AGENT ON SILICA PARTICLES

RELATED APPLICATIONS

This application is a continuation in part of U.S. patent application Ser. No. 13/730,708, filed on Dec. 12, 2012, and entitled "DETERGENT COMPOSITIONS AND DETERGENT COMPOSITIONS DISPERSED IN PERSONAL CARE PRODUCTS". This application is herein incorporated by reference for all that it contains.

FIELD OF THE INVENTION

The present invention generally relates to controlling the release of a cleaning agent to clean stains in an internal washing environment of a washing machine, and more particularly relates to controlling the release of the cleaning agent with silica particles.

BACKGROUND OF THE INVENTION

Antiperspirant stains are typically formed when an antiperspirant deodorant reacts with perspiration on clothing proximate a person's underarm. Such stains typically turn the clothing a yellowish color and are notoriously difficult to remove with conventional detergents.

Accordingly, it is desirable to have a cleaning agent that targets antiperspirant stains. In addition, it is desirable that the cleaning agent be active in an internal washing environment of a washing machine where fabric with such antiperspirant stains is generally washed. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A gel composition for controlling a release of a cleaning agent with silica particles includes silica particles disposed within the gel composition, the silica particles are configured to at least partially dissolve in an alkaline environment. The gel composition also includes a cleaning agent sorbed by the silica particles and configured to be released from the silica particles upon partial dissolution of the silica particles.

A stain remover product for controlling a release of a cleaning agent with silica particles includes a container and a gel composition housed within the container. The gel composition includes silica particles configured to at least partially dissolve in an alkaline environment and a cleaning agent sorbed by the silica particles and configured to be released from the silica particles upon partial dissolution of the silica particles.

A gel composition for controlling a release of a cleaning agent with silica particles includes silica particles forming 0.1 to 5.0 weight percent of the gel composition, water forming 1.0 to 40.0 weight percent of the gel composition, surfactant forming 60.0 to 95.0 weight percent of the gel composition, and an acidic cleaning agent sorbed by the silica particles. The acidic cleaning agent is configured to be released from the silica particles upon partial dissolution of the silica particles in an alkaline environment. The silica prevents the acidic cleaning agent from being affected by chemical properties of the gel composition.

BRIEF DESCRIPTION OF THE DRAWINGS

The present invention will hereinafter be described in conjunction with the following drawing figures, wherein like numerals denote like elements, and FIG. 1 is a diagram of an example of applying a gel composition to a stain on fabric according to the principles described herein.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Some cleaning agents are not compatible with the constituents of generally used cleaning products. For example, many cleaning products have an overall alkaline pH level, while the cleaning agent has an acidic pH level. As a result, the acidic nature of the cleaning agent would neutralize the pH of the cleaning product. Thus, if the acidic cleaning agent is added to the alkaline cleaning product, the pH would be neutralized before the cleaning product is applied to clothing. Such neutralization will render the cleaning product less effective for removing stains on fabric.

The principles described herein include a mechanism for preventing the properties of a gel composition from negatively affecting the efficacy of a cleaning agent that would otherwise be negatively impacted by the properties of the gel composition. Such a mechanism includes sorbing the cleaning agent with silica particles dispersed throughout the gel composition. The silica particles are configured to release the cleaning agent in an internal washing environment of a washing machine in response to coming into contact with a sufficient amount of water. As a result, the gel composition can be applied to the stains, such as antiperspirant stains, on fabric in a more conducive environment before the fabric is loaded into the washing machine without a reaction between the properties of the gel composition and the cleaning agent. Later, the silica particles will release the cleaning agent in the internal washing environment when the fabric is being cleaned. Thus, the cleaning agent is preserved during storage and during the application of the gel composition to the targeted stains. By applying the gel composition directly to the stain, the cleaning agent is released right into the target area of the fabric during the wash. By directly releasing the cleaning agent directly into the stained area, the cleaning agent can work on the stain before the cleaning agent is significantly affected by both the properties of the gel composition and the general alkaline properties in the internal washing environment. The cleaning agent may be negatively affected by any of the chemical properties of any of the other ingredients of the gel composition. In some examples, the gel composition has an overall alkaline property that can dilute the acidic nature of the cleaning agent without the sorbing action of the silica particles.

FIG. 1 is a diagram of an example of applying a gel composition (100) to a stain (102) on fabric (104) according to the principles described herein. In this example, the gel composition (100) is held within a container (106) that has an opening (108) that allows the gel composition (100) to flow out of the container (106) onto the fabric (104). Once applied to the fabric, the gel composition (100) can be rubbed deeper into the fabric (104), if desired by a user, before loading the fabric (104) into the internal washing environment of a washing machine.

Antiperspirant stains are notoriously difficult to remove from fabric. Antiperspirant stains are formed in response to antiperspirant compounds, such as those found in deodorants, reacting with perspiration. The antiperspirant stains are typically difficult to remove because the presence of iron in the antiperspirant compound can transfer to the fabric and oxidize on the fabric. Also, iron, calcium, and/or other inorganic metals found in the water used to previously wash the fabric can inhibit complete removal of the antiperspirant compound's ingredients, resulting in a buildup of the antiperspirant on the fabric after multiple wearings and washings. However, the principles described herein include cleaning agents that are well suited to remove such antiperspirant stains. These cleaning agents will be discussed in more detail below.

While the gel composition will be described with specific reference for targeting antiperspirant stains, any appropriate stains may be targeted in accordance with the principles described herein. For example, the target stains may be antiperspirant stains, mud stains, food stains, dye stains, pigment stains, marker stains, chemical stains, other types of stains, or combinations thereof. In some examples, the target stains are found on fabrics, but in other examples, the target stains are found on other surfaces.

The gel composition (100) may include the following ingredients and corresponding weight percents:

| Ingredient | Range (weight percent) |
|---|---|
| Water | 1.0-40.0 |
| Surfactant blend (anionic and nonionic) | 60.0-95.0 |
| Enzyme stabilizers | 0.0-5.0 |
| Viscosity modifiers | 0.0-3.0 |
| Enzyme | 0.0-5.0 |
| Fragrance | 0.0-1.0 |
| Preservative | 0.0-0.5 |
| Loaded silica | 0.0-5.0 |

The loaded silica contains a sorbed cleaning agent. Thus, the cleaning agent is held, as by absorption into or adsorption onto, the silica particles. The silica particles prevent the cleaning agent from reacting with the other ingredients of the gel composition while the gel composition is stored in the container and while the gel composition resides on the stained fabric prior to washing. The silica particles can be configured to dissolve in an alkaline environment, such as during laundry washing.

While the silica particles are described as having specific weight percents, any appropriate weight percent of silica particles may be used in accordance with the principles described herein. A low weight percentage of the loaded silica particles (0.0 wt % to 5.0 wt %) may not significantly interfere with the gel composition's ability to flow. For example, the gel composition (100) can flow out of the container (106) onto the stained fabric through the container's opening (108). The container (106) may use any appropriate mechanism to make the gel composition available to users according to the principles described herein. For example, the container (106) may include a replaceable lid that when removed unblocks the container's opening (108) through which the gel composition (100) can be poured. In other examples, a user can squeeze a body of the container to create an internal pressure within the container (106) to cause the gel composition to flow through the opening (108). In yet other examples, a replaceable lid covers a perforated surface of the container (106) that allows controlled amounts of gel composition (100) to flow through in response to an internal pushing mechanism that pushes the gel composition through the perforated surface.

The container (106) may also include a brush or another mechanism with which a user can rub the gel composition (100) into the fabric (104) after the gel composition (100) has been applied to the stained areas of the fabric (104). In other examples, the user can use other devices not attached to the container (106) to rub the gel composition (106) into the fabric (104). Rubbing causes the gel composition (100) to be further embedded into the fabric (104). By depositing and rubbing the gel composition (100) into the stained area of the fabric (104), the cleaning agent is positioned to contact the stain when it is released from the silica particles when the cleaning agent is most effective, just after the cleaning agent is released. For example, if the cleaning agent is highly acidic, the cleaning agent's acidity will be diluted by the alkaline environment in the washing machine. However, when the cleaning agent is released from the silica particles, the cleaning agent can act on the stain before the cleaning agent's acidic properties are significantly diluted by the surrounding alkaline environment.

The silica particles of the gel composition (100) are dispersed through out the gel composition (100) and allow the cleaning agent to be held for release upon introduction to a washing environment. The washing environment may be an internal washing environment in a washing machine. In other examples, the washing environment is in a bucket, bathtub, or other water vessel that is intended for washing fabrics by hand, with a wash board, or with another mechanical cleaning mechanism.

The silica particles may be configured to dissolve in an alkaline environment having, for example, a pH of at least 7, of at least 8, of at least 9, or of at least 10, such as at least about 11. Typical laundry detergent provides such an alkaline environment during washing. The cleaning agent may be held by the silica particles until the silica particles are at least partially dissolved in the mixture of water and laundry detergent in a washing machine. Upon partial dissolution of the silica particles, the cleaning agent is released on the fabric and may remove or inhibit formation of a stain on the fabric.

The silica particles may include porous and/or nonporous particles. In some examples, the silica particles include at least some hydrophobic silica particles. Hydrophobic silica particles can encompass silica particles having varying levels or degrees of hydrophobicity. The degree of hydrophobicity imparted to the silica particles will vary depending upon the type and amount of treating agent used to cause the silica particles to be hydrophobic.

In some examples, hydrophobic silica particles are formed from treated silica particles, such as by fuming or co-fuming the silica particles with silanes or siloxanes. The silica particles may be fumed with the hydrolysis of suitable feed stock vapor (such as silicon tetrachloride) in a flame of hydrogen and oxygen. Molten particles of roughly spherical shape are formed as a result, and the particle diameters may be varied through control of process parameters. These molten spheres, referred to as primary particles, fuse with one another by undergoing collisions at their contact points to form branched, three dimensional chain-like aggregates. The formation of the aggregates is considered to be irreversible as a result of the fusion between the primary particles. During cooling and collecting, the aggregates undergo further collisions that may result in some mechanical entanglements to form agglomerates. These agglomerates are thought to be loosely held together by van der Waals forces and can be reversed, i.e. de-agglomerated, by proper dispersion in a suitable media. Mixed or co-fumed silica particles may also be produced utilizing other techniques. While the silica particles have been described with reference to specific methods for forming the silica particles, any appropriate method of forming the silica particles may be used in accordance with the principles described herein.

The silica particles described herein may include other oxides such as those of aluminum, titanium, zirconium, iron, niobium, vanadium, tungsten, tin, germanium, or combinations thereof. Such aggregates may be formed by introducing appropriate feed stocks (e.g. chloride compounds) into a flame in conjunction with an appropriate fumed silica feed stock. A non-limiting example of fumed silica particles includes AEROSIL® fumed silica available from Evonik Corporation.

In some examples, the treated silica particles have a BET surface area (ASTM D6556-07) of about 35 $m^2/g$ to about 700 $m^2/g$, for example, greater than about 60 $m^2/g$, greater than about 80 $m^2/g$, greater than about 130 $m^2/g$, or greater than about 150 $m^2/g$; less than about 400 $m^2/g$, less than about 290 $m^2/g$, less than about 250 $m^2/g$; or about 200 $m^2/g$. While the silica particles have been described with reference to specific surface areas, the silica particles may have any appropriate surface area.

The silica particles may include a mixture of silica particles having different degrees of hydrophobicity. For example, the silica particles may include a first portion of hydrophobic silica particles and a second portion of hydrophobic silica particles that is less hydrophobic than the first portion. In some examples, the ratio of more hydrophobic particles to less hydrophobic particles is no more than 50:50, such as less than about 33:66, such as about 25:75. Of course, the ratio of more hydrophobic particles to less hydrophobic particles can be varied to deliver a desired release of the sorbed cleaning agent in the highly alkaline wash environment while inhibiting early non-desired release of the sorbed cleaning agent. Such ratios may range from 1:10 to 10:1. While these examples have been described with reference to specific ratios of varying amounts of hydrophobicity of the silica particles, any appropriate ratio may be used. In other examples, the silica particles include three or more portions that have different degrees of hydrophobicity to control the release of the cleaning agent from the silica particles.

In a non-limiting example, at least some of the silica particles are porous. Such silica particles contain an inner portion and an outer coating with the inner portion being less hydrophobic than the outer coating. The cleaning agent is sorbed by the inner portion of the silica particles. In other words, as a result of the post-loading treatment, the silica particles may be considered to have a less hydrophobic inner portion and a more hydrophobic outer coating. Such an arrangement can control the release timing of the sorbed cleaning agent by making such silica particles more resistant to releasing the cleaning agent.

While the examples above have been described with reference to specific mechanisms for controlling the release of the cleaning agent, any appropriate mechanism for controlling how and when the silica particles release the cleaning agent may be used in accordance with the principles described herein. For example, some of the mechanisms described above may be used to cause some amount of the cleaning agent to be released immediately upon initial introduction into an alkaline environment while other silica particles are modified to delay a release of the cleaning agent or to slow the release of the cleaning agent. Such timing can provide for a more continuous release of the cleaning agent during the wash cycle to provide a more continuous exposure to the stain while the cleaning agent is most effective.

The cleaning agent may be any appropriate cleaning agent for removing stains that would otherwise be incompatible with the other ingredients of the gel composition. For example, the cleaning agent may include a phosphoric acid, an alpha hydroxy acid, an acid precursor, another type of acid, a surfactant, another type of material, or combinations thereof. In some examples, the cleaning agent is an aqueous material. In other examples, portions of the cleaning agent include solid materials. An aqueous material of the cleaning agent may have a pH of less than about 3.5, for example less than about 2, such as less than about 1.5, for example less than about 1.

The silica particles are hydrophobic such that after sorbing the cleaning agent, the silica particles impede contact between water and the cleaning agent, which prevents the release of the cleaning agent. To further reduce the cleaning agent's exposure to water, the gel composition may include minimal amounts of water, such as less than 5.0 weight percent. The silica particles are configured to dissolve in high pH environments, such as in a laundry washing environment. In some examples, upon even partial dissolution, the silica particles no longer inhibit the cleaning agent's exposure to water, which results in the cleaning agent being released into the washing environment.

Hydroxy acid refers to a compound having a carboxylic acid functionality and a hydroxy functionality. Alpha-hydroxy acids have a mono- or polycarboxylic acid containing one or more hydroxyl functions, at least one of these hydroxyl functions occupies a position alpha to the acid (carbon adjacent to a carboxylic function). In certain examples, the alpha hydroxy acid is selected from linear or branched alpha hydroxy acids no more than six carbon atoms and aromatic alpha hydroxy acids. The detergent compositions may, of course, contain one or more alpha hydroxy acids. The alpha hydroxy acid may include, without limitation, gluconic acid, malic acid, citric acid, glycolic acid, lactic acid, mandelic acid, methyllactic acid, phenyllactic acid, tartronic acid, tartaric acid, benzylic acid, 2-hydroxycaprylic acid, salicylic acid, maleic acid, pyruvic acid, hydroxy-octanoic acid, or combinations thereof. Alpha hydroxy acids may cause local irritation when applied to sensitive areas of the skin. Thus, the silica particles do not just prevent the cleaning agent from being affected by the other ingredients of the gel composition, but the silica particles can also protect the user's skin while rubbing the gel composition into the fabric.

Phosphoric acid may also be used in the gel composition as an acidic agent and/or as complexing or softening agents to reduce the hardness of the water in the washing environment. Water softeners remove Ca2+ and Mg2+ ions from "hard" water. If not removed, these hard-water ions react with soap and form insoluble deposits that cling to laundry and the washing machine. The phosphoric acid causes the Ca2+ and Mg2+ ions to form soluble chemical species, called complexes or chelates. These complexes prevent the Ca2+ and Mg2+ from reacting with soap and forming deposits. Phosphoric acid can also be a skin irritant or even cause burns depending on the concentration and duration of contact. Therefore, sorbing the phosphoric acid into silica particles may enable the use of phosphoric acid at high concentrations in personal care products without irritation or injury.

While the above examples have been described with reference to specific types of acids as the cleaning agent, any appropriate acid or other type of agent may be used in accordance with the principles described herein. For example, other acids, such nitric acid, sulfamic acid, hydrochloric acid, and hydroxyacetic acid may be included in the gel composition. Further, the cleaning agent may work in conjunction with acid salts or other non-aqueous agents.

An acid salt may include any appropriate salt in the gel composition, such as water soluble acid salts, citric acid salts, citrates, sodium citrates, monosodium citrate, sodium dihydrogen citrate, other types of salt, or combinations thereof. The acid salts may be used to directly assist with cleaning the fabric, or the acid salts may indirectly assist with cleaning the fabric such as by reducing water hardness. Acid salts may be included to provide additional acidity when the cleaning agent is released in the laundry washing environment. Specifically, the acid mixture of the sorbed cleaning agent may promote the acid salt to turn into an acid. For example, sodium dihydrogen citrate may be driven to citric acid. As a result, the deliverable amount of citric acid to the targeted stained area may be higher than the amount of citric acid in the sorbed cleaning agent. By using acid salts, the increased amount of acid delivered to the stain is achieved without increasing skin irritation to the user.

A majority of the gel composition can include a surfactant. In some examples, the surfactant constitutes 60.0 to 95.0 weight percent of the gel composition. A surfactant is a compound that lowers the surface tension of a liquid or the interfacial tension between two liquids or between a liquid and a solid. When added to water for laundering, a surfactant significantly reduces the surface tension of the water allowing the water to penetrate the fabric rather than slide off the fabric's surface. The result is that the water can function more effectively, acting to loosen the dirt from the clothing, and then hold the dirt until the dirt can be washed away.

Surfactants have a hydrophobic end and a hydrophilic end. The hydrophobic end has an uncharged carbohydrate group that can be straight, branched, cyclic or aromatic. Depending on the nature of the hydrophilic part the surfactants are classified as anionic, nonionic, cationic or amphoteric. Anionic surfactants have a hydrophilic end that has a negatively charged group like a sulfonate, sulfate, or carboxylate and are sensitive to water hardness. Nonionic surfactants include a non-charged hydrophilic part, e.g. an ethoxylate. Nonionic surfactants are not sensitive to water hardness. Cationic surfactants have a hydrophilic end that contains a positively-charged ion. Amphoteric surfactants or Zwitterionic surfactants have both cationic and anionic centers attached to the same molecule. The surfactants in the gel composition may include any appropriate type of mixture of surfactants. For example, the surfactants may include a blend of anionic and nonionic surfactants.

A predominately surfactant based gel composition may have a sufficient thickness to have a yield point that allows for the suspension of the silica particles in the gel composition. Thickness of the gel composition can also be controlled through the addition of viscosity modifiers. Further, adding too many silica particles may also affect the gel composition's ability to flow. Silica particles under 5.0 weight percent of the gel composition may minimally impact the gel composition's ability to flow from the container as desired for commercial and household use.

The gel composition may include 1.0 to 40.0 weight percent of water. The amount of water in the gel composition can be kept low to prevent premature dissolution of the silica particles and thereby premature release of the cleaning agent.

In some examples, enzymes and enzyme stabilizers may be included in the gel composition. For example, the gel composition may include 0.0 to 5.0 weight percent of enzymes. Further, the gel composition may include 0.0 to 5.0 weight percent of enzymes stabilizers. An enzyme may be a microorganism that facilitates preventing, removing, or minimizing a fabric stain. Some examples of enzymes include protease, lipase, amylase, mannanase, and/or the like. An enzyme stabilizer is a compound that prevents the enzyme from being negatively impacted by the properties of the gel composition or the surrounding environment.

Fragrances may be included in the gel composition to provide the gel composition with a pleasant smell. A non-exhaustive list of fragrances that may be used in the gel composition include triclosan, triclocarban, usnic acid salts, zinc phenolsulfonate, b-chloro-D-alanine, D-cycloserine, animooxyacetic acid, cyclodextrine, sodium bicarbonate, and combinations thereof.

Further, the gel composition may include preservatives and viscosity modifiers. The viscosity modifiers may control how easily the gel composition flows through the opening of the container.

Any appropriate method of making the gel composition, the silica particles, and/or the cleaning agent may be used in accordance with the principles described herein. A method for making the gel composition includes mixing water, the cleaning agent, and in some cases additional materials to form an aqueous cleaning agent. The aqueous cleaning agent may have a pH of less than 2, such as less than 1. The aqueous cleaning agent remains flowable despite its high acid content. Further, the method may include mixing acid salts, such as citrates, into the gel composition.

After the aqueous cleaning agent is prepared, it may be sorbed by the silica particles. As explained above, the silica particles may include hydrophobic silica particles having a substantially uniform hydrophobicity, or two or more portions of hydrophobic silica particles having different levels of hydrophobicity. After sorbing the aqueous cleaning agent with the silica particles, the gel composition may be loaded into the container (108).

In certain examples, after sorbing the aqueous cleaning agent with the silica particles, a second hydrophobicity treatment is performed. Specifically, the loaded hydrophobic particles are post-treated with particles having higher hydrophobicity. As a result, the loaded silica particles are imparted with a coating having higher hydrophobicity. The internal portion of the loaded silica particles retains its lower hydrophobic level.

While the above examples have been described with reference to specific types of cleaning agents, any appropriate cleaning agent may be used in accordance with the principles described herein. For example, the cleaning agents may be used to remove stains, inhibit the formation of stains, or otherwise contribute to cleaning the stains. In some examples, the cleaning agent contributes directly to cleaning the stain by directly working on the stains. In other examples, the cleaning agent indirectly cleans the stains. For example, the cleaning agent may lower the water hardness, affect the washing environment in another way, or combinations thereof. Further, the cleaning agent may include multiple types of cleaning agents that work on the stains. In such examples, each of the cleaning agents may perform different functions, perform overlapping functions, perform the same functions, or combinations thereof.

While the examples above have been described with specific reference to cleaning agents that are acidic, the cleaning agent may have any appropriate property that contributes to cleaning fabric in accordance with the principles described herein. For example, the cleaning agent may have an acidic property, an alkaline property, an abrasive property, a chemical property, a surfactant property, another type of property, or combinations thereof that contribute to cleaning fabric.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A gel composition for controlling a release of a cleaning agent with silica particles, comprising:

a.) 0.1 to 5.0 wt. % of hydrophobic silica particles disposed within the gel composition;

b.) 1.0 to 40.0 wt. % of water;

c.) 60.0 to 95.0% surfactant;

d.) a cleaning agent sorbed by the silica particles and releasable from the silica particles upon partial dissolution of the silica particles; and e.) an enzyme.

2. The gel composition of claim 1, wherein the cleaning agent is selected from the group consisting of phosphoric acid, alpha hydroxy acid, nitric acid, sulfamic acid, sodium acid sulfate, hydrochloric acid, hydroxyacetic acid, citric acid, gluconic acid, or combinations thereof.

3. The gel composition of claim 1, wherein the silica particles at least partially dissolve in an alkaline environment having a pH of at least 7.

4. The gel composition of claim 1, wherein the silica particles at least partially dissolve in an alkaline environment having a pH of at least 10.

5. A stain remover product for controlling a release of a cleaning agent with silica particles, comprising:

1) a container; and 2) a gel composition housed within the container, wherein the gel composition comprises:

a.) 0.1 to 5.0 wt. % of hydrophobic silica particles disposed within the gel composition;

b.) 1.0 to 40.0 wt. % of water;

c.) 60.0 to 95.0% surfactant;

d.) a cleaning agent sorbed by the silica particles and releasable from the silica particles upon partial dissolution of the silica particles; and e.) an enzyme.

6. The product of claim 5, wherein the cleaning agent is selected from the group consisting of phosphoric acid, nitric acid, alpha hydroxy acid, sulfamic acid, sodium acid sulfate, hydrochloric acid, hydroxyacetic acid, citric acid, gluconic acid, or combinations thereof.

7. The product of claim 5, wherein the container comprises an opening that allows the gel composition to flow out of the container.

8. The product of claim 5, wherein the gel composition further comprises at least one viscosity modifier from 0.1 to 3.0 weight percent.

* * * * *